US005524372A

United States Patent [19]

Trotta et al.

[11] Patent Number: 5,524,372

[45] Date of Patent: Jun. 11, 1996

[54] REVOLVING BACKLIT SIGN

[75] Inventors: Frank A. Trotta, Lebanon; Kevin Keizer, Pittstown, both of N.J.

[73] Assignee: Intermark Corp., South Kearny, N.J.

[21] Appl. No.: 333,002

[22] Filed: Nov. 1, 1994

[51] Int. Cl.[6] ..... G09F 13/04

[52] U.S. Cl. ..... 40/502; 40/472

[58] Field of Search ..... 40/472, 502, 506, 40/524, 525, 564, 483

[56] References Cited

U.S. PATENT DOCUMENTS

| | | | |
|---|---|---|---|
| 569,982 | 10/1896 | Ward et al. | 40/483 |
| 2,047,440 | 7/1936 | Sloss | 40/472 X |
| 3,395,472 | 8/1968 | Look | 40/472 |
| 3,703,778 | 11/1972 | Pfleger | 40/472 |
| 3,762,822 | 10/1973 | Harvey et al. | 356/429 |
| 4,110,922 | 9/1978 | Leemann-Dittmann | 40/472 X |
| 4,201,002 | 5/1980 | Barton | 40/472 X |
| 4,255,889 | 3/1981 | Logan | 40/518 |
| 4,318,237 | 3/1982 | Hicks | 40/502 |
| 5,138,781 | 8/1992 | Claver | 40/472 X |

*Primary Examiner*—Peter M. Cuomo
*Assistant Examiner*—James O. Hansen
*Attorney, Agent, or Firm*—Hedman, Gibson & Costigan

[57] ABSTRACT

A revolving backlit sign having a continuous translucent medium which engages the perimeter of a plurality of translucent drive rollers, the drive rollers being rotated by a drive band associated with an electric motor, and one or more light sources located within the perimeter of the drive rollers. A housing is also provided which encloses the drive rollers and continuous medium.

13 Claims, 4 Drawing Sheets

REVOLVING BACKLIT SIGN

FIELD OF THE INVENTION

The present invention relates to the field of promotional signs for the advertisement of goods and/or services.

BACKGROUND OF THE INVENTION

Numerous types of promotional signs have been developed over the years to attract consumer's attention to a seller's product and/or service. These have included neon lighted signs, plaques and billboards with movable parts, electronic signs with alternating bulbs for the appearance of moving text, three dimensional articles which are stationary or revolve and the like.

New advertising items are continuously being developed to attract customers. The most successful generally include a display which is easy to maintain but provides either movement or light to catch a viewer's attention. However, different arrangements of parts, including movable parts and lighting provide varying results.

SUMMARY OF THE INVENTION

The other objects of the present invention are achieved by a sign comprising a plurality of substantially transparent drive rollers, drive means associated with at least one of said drive rollers, a continuous translucent medium on which an advertisement is printed which engages the exterior perimeter of said drive rollers, light sources located intermediate said plurality of drive rollers, at least one light source being associated with and located behind each of said drive rollers and housing means.

In its preferred embodiment, the sign of the present invention has at least two sides, i.e. when two drive rollers are used, with the drive rollers at the corners or ends thereof. The drive means includes an electric motor which engages a drive band, with the drive band further engaging each of the drive rollers.

The light sources for use in the present invention are preferably fluorescent lamps located on the line between opposed drive rollers, with at least one light source behind each drive roller. The internal structure at the level of the lamps includes parts made of thin or clear or translucent material to aid light dispersal, including and most importantly, the drive rollers.

The housing of the sign includes upper and lower housing members and a transparent lens within and between said housing members. The continuous medium is preferably at least as high as the lens with the drive rollers placed such that the medium travels close to the lens.

The frame structure which holds the drive rollers is preferably at the top and bottom, within the upper and lower housing members, and intermediate the light sources so as to avoid casting shadows on the continuous medium. Alternatively, the structure can be translucent so that it does not interfere with the light dispersal onto the back of the translucent medium.

BRIEF DESCRIPTION OF THE DRAWINGS

The accompanying drawings, in which like reference characters represent like parts, are intended to illustrate the present invention without limiting the invention in any manner whatsoever.

DETAILED DESCRIPTION OF THE PREFERRED EMBODIMENT

Figure 2:
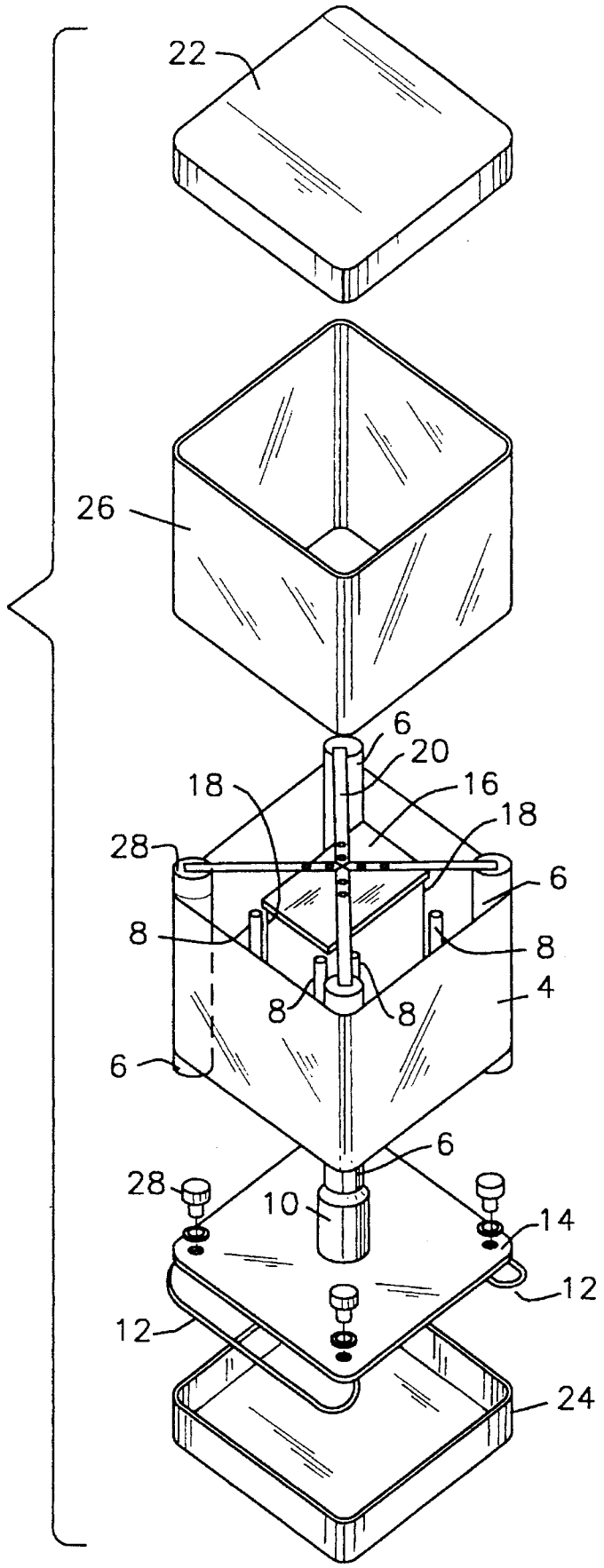
FIG. 2 is an exploded view of the embodiment of FIG. 1.
Figure 1:
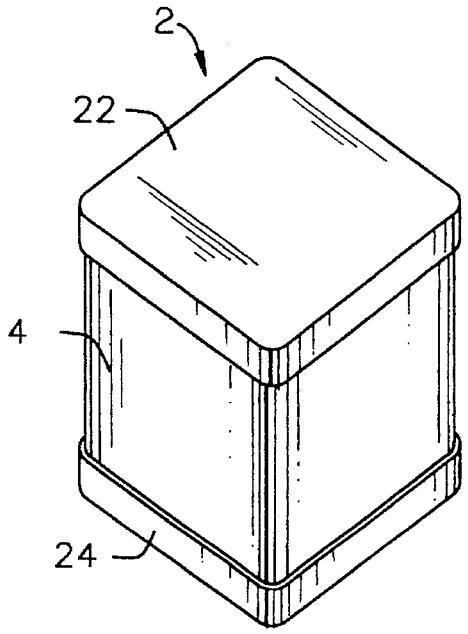
FIG. 1 is a perspective view of a preferred embodiment of the present invention.

The sign 2 of the present invention includes a continuous translucent medium 4 held by and encompassing the perimeter of a plurality of substantially transparent or translucent drive rollers 6. In the area within the continuous medium 4 and drive rollers 6 are a number of light sources 8, wherein at least one light source is located behind each of said drive rollers 6.

Also in this intermediate area is located drive means 10 to engage a drive band 12 which uniformly rotates said drive rollers 6. The drive rollers 6 are preferably held in place by a frame structure which includes a lower frame member 14, an upper frame member 16, vertical support members 18 and upper support arms 20.

Housing means contain the mechanical parts and preferably include an upper housing member 22, a lower housing member 24 and transparent lens means 26.

Figure 3:
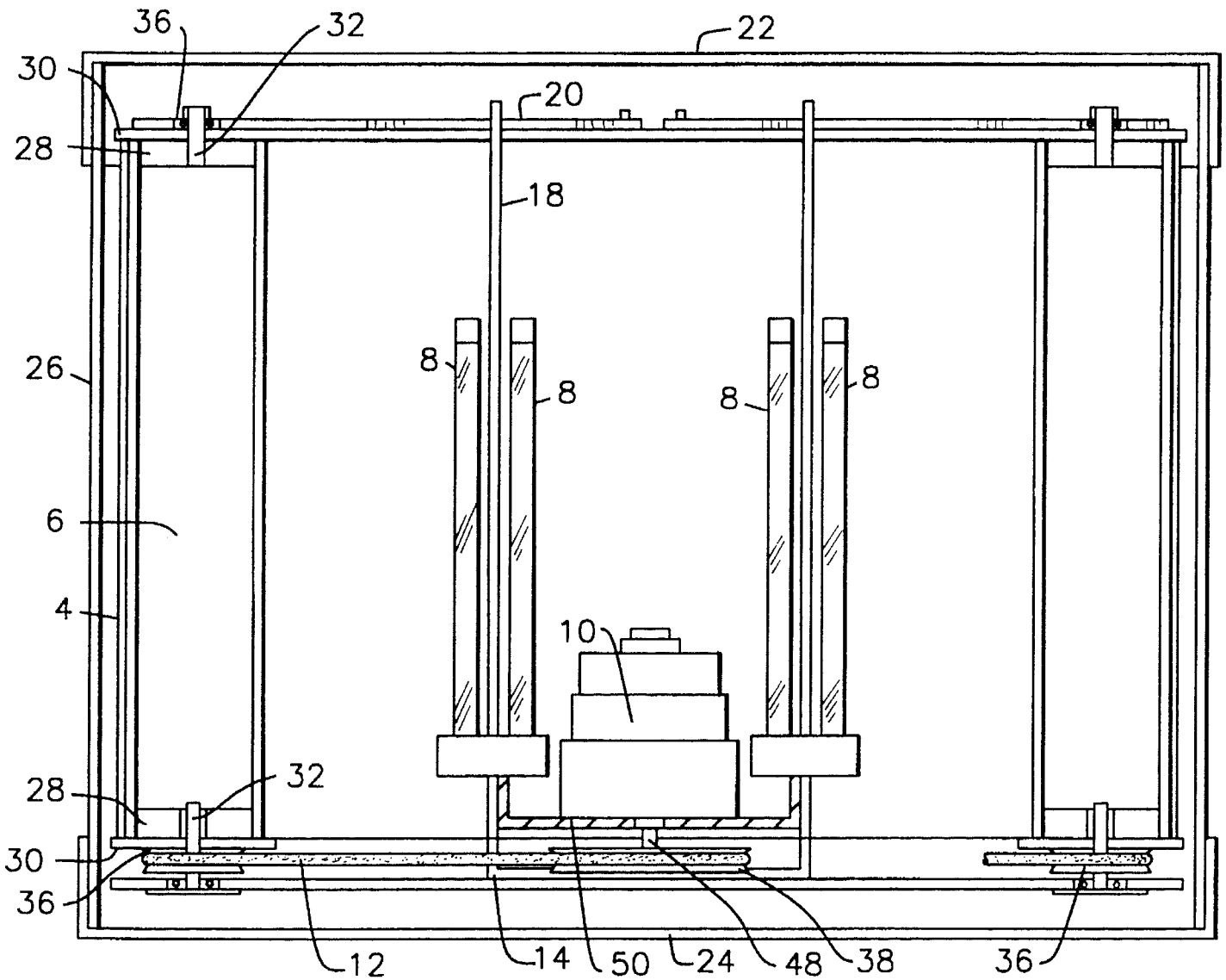
FIG. 3 is a side elevation of the embodiment of FIG. 1 in cross section.

In the preferred embodiment, the sign 2 comprises four drive rollers 6 at the corners of a square with 24 to 30 inches between the axes of the rollers 6. The rollers 6 are clear plastic cylinders which are about 18 inches tall with a diameter of about 3 inches, made of about ¼ inch thick transparent plastic material. The top and the bottom of the rollers 6 have roller caps 28 with ridges 30 that hold the continuous medium 4 in place on the rollers 6 (see FIG. 3).

The rollers 6 are held between the upper support arms 20 and lower frame member 14. Pins 32 extending from the roller caps 28 are engaged by ball bearings 34 on the support arms 20 and lower frame member 14 for ease of rotation.

Additionally, a pulley 36 is preferably affixed to the pin 32 of the lower roller cap 28 of each drive roller 6. The pulley 36 is adapted to accept the drive band 12 associated with the drive means 10 to rotate the drive rollers 6.

The drive band 12 is preferably a round elastic band made of rubber or a similar natural or synthetic material. A product which has been found to work well in this application is SHINGLE ROUNTHANE ¼.

Figure 5:
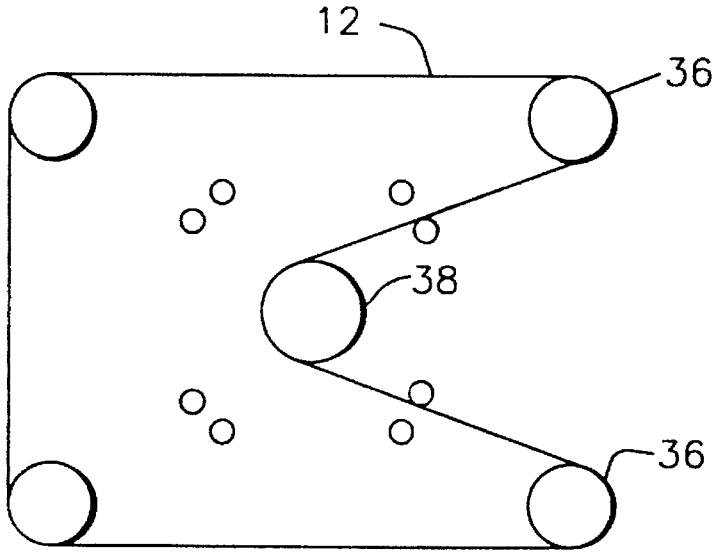
FIG. 5 is a plan view of the drive band threading arrangement of the preferred embodiment of FIG. 1.

FIG. 5 shows the preferred threading arrangement of the drive band 12 to engage the drive pulley 38 associated with the drive means 10 and each of the roller pulleys 36.

Figure 6:
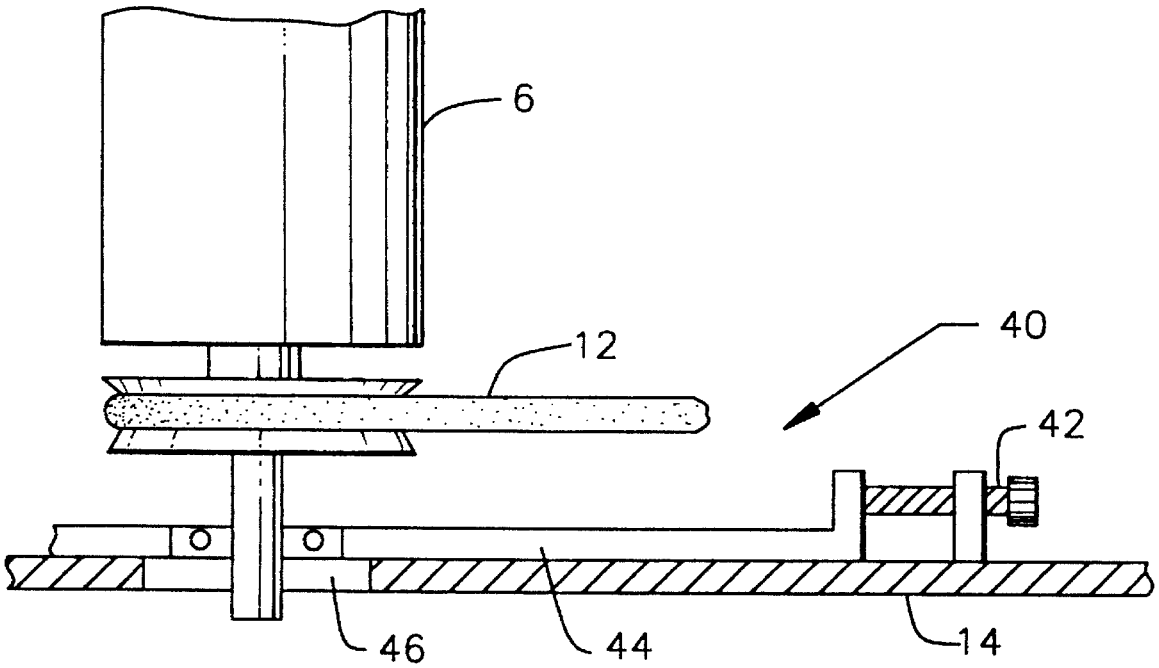
FIG. 6 is an elevational view of a portion of a drive roller having preferred drive band adjustment means.

In its preferred embodiment the present invention includes tensioning means 40 associated with one of the drive rollers 6 to provide proper tension to the drive band 12. As shown in FIG. 6, one preferred method is the use of an adjustment screw 42 which engages a movable plate 44 on the lower frame member 14. The movable plate 44 includes the ball bearings 34 in which the pin 32 of the drive roller 6 sits. The lower frame member 14 is provided with a slot for the pin 32 to travel during tensioning. Alternatively, the pin 32 can be shortened so that it rides above the lower frame member 14 and no slot is necessary.

A drive pulley 38 is associated with and is rotated by the drive means 10. The drive means 10 preferably comprises an electric motor located intermediate the drive rollers 6 and the light sources 8.

Most preferred as the drive means 10 is a shaded pole type electric motor with 1/400 to 1/200 hp and about 22.5 in-lbs torque running at 60 hz with impedance protection. The preferred motor also has a closed grease filled gear box, the gears being heat treated cut steel and acetal with porous bronze sleeve bearings, and an all position mounting with a sealed gear box without grease throw.

Although the rate of travel of the continuous medium 4 depends on the "readability" of the graphics, and particular text, the preferred rate is in the range of about 120–160 linear inches per minute. A gear reduction yielding about 6 rpm with a 4" drive pulley 38 and 2" roller pulley 36 governing a 3" drive roller 6 satisfies this rate.

Figure 4:
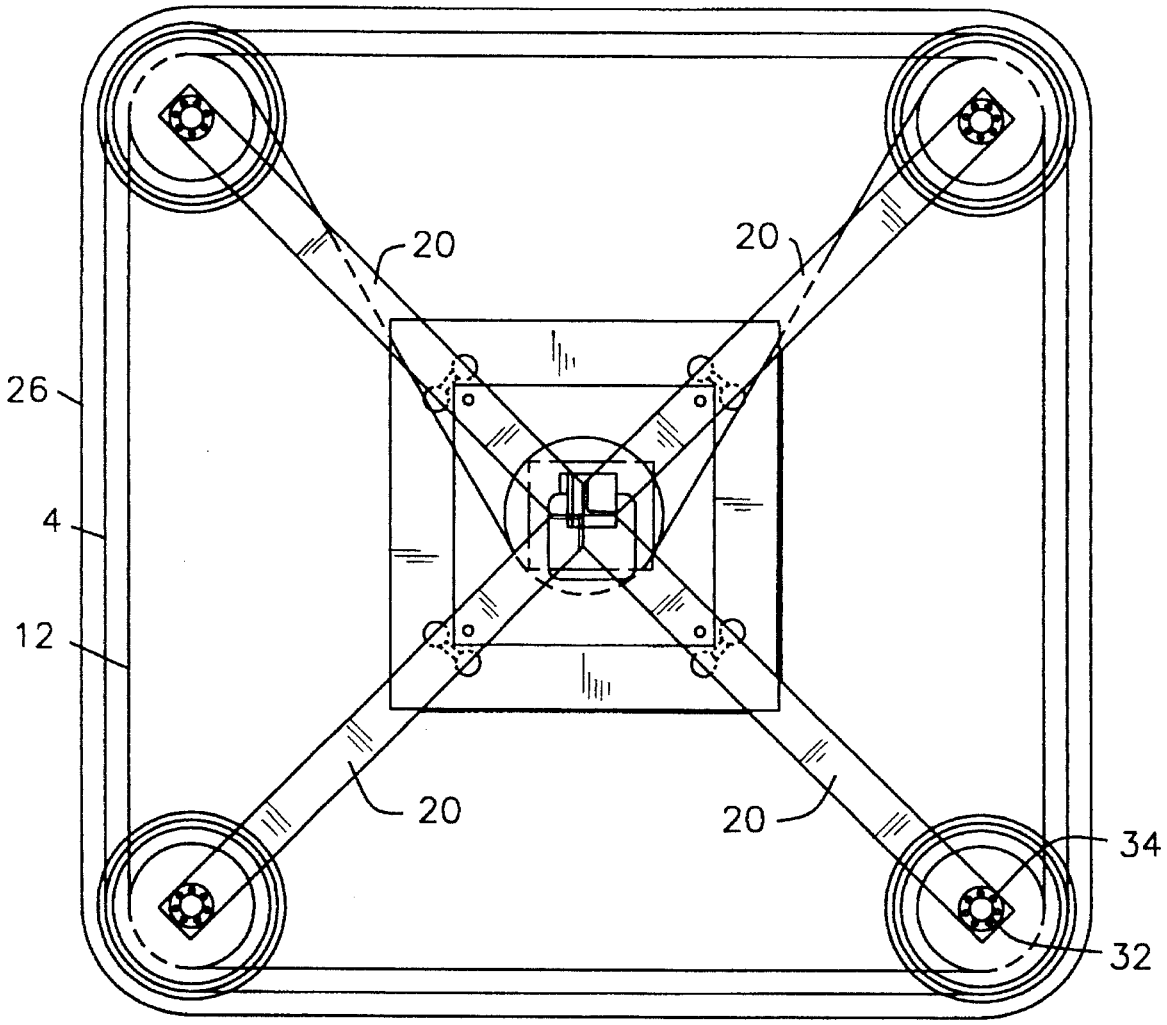
FIG. 4 is a top plan view of the embodiment of FIG. 1 with the upper housing member removed.

The light sources 8 located behind the drive rollers 6 are preferably PLS type fluorescent lamps rated at 13 watts with a color temperature of 4100 k. With these lamps, a minimum distance of 5½ inches from the preferred acrylic drive rollers 6 is recommended. In the most preferred embodiment, having four sides, four lamps are used at the corners of the center core, on line between the center and normal the drive rollers 6. This is best shown in FIG. 4 where the light sources 8 are shown as placed behind the drive rollers 6 on the vertical support members 18 of the frame structure.

Preferably, a transformer is associated with each lamp, having a rating of 2 watts at 0.32 amps. In its most preferred embodiment, four transformers are mounted two on opposed sides for balance and power distribution.

Although fewer light sources 8 can be used, it has been found that the use of at least one light source 8 behind each of the transparent or translucent drive rollers 6 provides good light dispersal across the translucent medium 4. Placement behind the transparent or translucent drive rollers 6 has been found to reduce the undesired effects of bright and dark spots at various points around the continuous medium 4.

The frame structure preferably includes the lower frame member 14, upper frame member 16 and upper support arms 20 which are preferably made of ⅛ inch thick aluminum sheet material. Additionally, the frame structure includes vertical support members 18. In the preferred embodiment, the upper support arms 20 are used in conjunction with the upper frame member 16, to allow the use of a smaller upper frame member 16. Alternatively, an upper frame member 16 large enough to engage the top pins 32 of each roller 6 can be used.

However, when the support arms 20 are used as presently contemplated they are preferably u-shaped members with a flat bottom and short sides to provide additional strength. One end of each arm 20 includes the ball bearings 34 for engaging the pins 32 of the drive rollers 6 and the other end engages and is fixed to the upper frame member 16.

The vertical support members preferably comprise thin threaded rods or the like which are placed between the upper and lower frame members 16 and 14. The threaded rods are then engaged with nuts (not shown) on the upper frame member 16 and the upper support arms 20 to secure the frame structure.

Additionally, the vertical support members 18 themselves or the lower frame member 14, at a point between the vertical support members 18 and the drive rollers 6, include means to engage receptacles (not shown) to receive and mount the light sources 8.

Similarly, the drive means 10 is preferably mounted to a mounting plate 50, supported by the vertical support members 18 or the lower frame member 14. The mounting plate 50 has a hole in it for the drive shaft 48 to pass and engage the drive pulley 38 on which the drive band 12 rides.

The housing preferably comprises an upper housing member 22 and a lower housing member 24 which are preferably injection molded to form opaque plastic trays. The vertical sections of the trays of the upper and lower housing members 22 and 24 are sized to snugly accept and engage the lens 26. Preferably, the members 22 and 24 and the lens 26 are dimensioned to leave only a minimum space between the lens 26 and the continuous translucent medium 4 over the drive rollers 6, including having rounded corners of just over the diameter of the rollers 6 as necessary to fit closely therein.

Obvious variations, which will be apparent to one skilled in the art from a reading of the foregoing disclosure, are intended to fall within the spirit and scope of the present invention limited only by the appended claims.

We claim:

1. A sign comprising four translucent drive rollers arranged about a perimeter, a continuous translucent medium upon which a message is presented adapted to move around the perimeter of said drive rollers, drive means for advancing said continuous translucent medium associated with at least one of said drive rollers, four light sources located within the perimeter of said plurality of drive rollers, one light source associated with and located behind each of said drive rollers on a line from the associated drive roller to a center point of the perimeter of the drive rollers, and housing means for enclosing said drive rollers and continuous translucent medium.

2. The sign of claim 1 wherein said drive rollers are substantially transparent.

3. The sign of claim 1 wherein said drive rollers comprise means for engaging said continuous translucent medium.

4. The sign of claim 1 wherein the drive means comprises an electric motor, a drive pulley associated with the electric motor, a roller pulley on the at least one drive roller associated with the drive means and a drive belt which engages the drive pulley and the roller pulley.

5. The sign of claim 4 wherein each of the drive rollers has a roller pulley which is engaged by the drive belt.

6. The sign of claim 4 further comprising tensioning means for adjusting the tension of the drive belt.

7. The sign of claim 1 wherein the light sources are PLS type fluorescent lamps.

8. The sign of claim 1 wherein the housing means comprises an upper housing member, a lower housing member and lens means.

9. The sign of claim 1 further comprising frame means for maintaining the drive rollers in place, said frame means comprising a lower frame member associated with a lower portion of the drive rollers, an upper frame member associated with an upper portion of the drive rollers and support members for maintaining the upper and lower frame members in place.

10. The sign of claim 9 wherein the upper frame member comprises an upper frame plate and support arms wherein the support arms comprise two ends, one end of which engages the upper portion of the drive rollers and the other end of which engages the upper frame plate.

11. The sign of claim 9 wherein the drive rollers have a top and a bottom, each havinq an axial center, and comprise axial pins protruding from the axial center of the top and bottom of the drive rollers and further wherein the upper and lower frame members include ball bearings for engagement of the axial pins.

12. The sign of claim 9 wherein the light sources are mounted on said frame means.

13. The sign of claim 9 wherein the drive means comprises an electric motor and the frame means further comprises a mounting plate on which said electric motor is mounted.

* * * * *